United States Patent [19]

Yabe

[11] Patent Number: 5,072,780

[45] Date of Patent: Dec. 17, 1991

[54] METHOD AND APPARATUS FOR AUGMENTATION OF CONVECTION HEAT TRANSFER IN LIQUID

[75] Inventor: Akira Yabe, Tsukuba, Japan

[73] Assignee: Agency of Industrial Science & Technology, Ministry of International Trade & Industry, Tokyo, Japan

[21] Appl. No.: 437,665

[22] Filed: Nov. 17, 1989

[30] Foreign Application Priority Data

Nov. 18, 1988 [JP] Japan ..... 63-291791

[51] Int. Cl.[5] ..... F28F 13/16

[52] U.S. Cl. ..... 165/1; 165/96

[58] Field of Search ..... 163/1; 165/96

[56] References Cited

U.S. PATENT DOCUMENTS

| | | | |
|---|---|---|---|
| 2,605,377 | 7/1952 | Kaehni et al. | 165/1 |
| 2,748,356 | 5/1956 | Kaehni | 165/1 |
| 3,056,587 | 10/1962 | Steigerwald | 165/1 |
| 3,398,784 | 8/1968 | Smith et al. | 165/1 |
| 4,401,148 | 8/1983 | Yake et al. | 165/1 |
| 4,471,833 | 9/1984 | Yake et al. | 165/1 |
| 4,818,184 | 4/1989 | Yabi et al. | 417/48 |

FOREIGN PATENT DOCUMENTS

| | | | |
|---|---|---|---|
| 58-37495 | 3/1983 | Japan . | |
| 58-37496 | 3/1983 | Japan . | |
| 59-5837 | 2/1984 | Japan . | |
| 59-66342 | 4/1984 | Japan . | |
| 59-41117 | 10/1984 | Japan . | |
| 61-225590 | 10/1986 | Japan . | |
| 0225591 | 10/1986 | Japan | 165/1 |
| 61-225592 | 10/1986 | Japan . | |
| 61-225899 | 10/1986 | Japan . | |
| 62-228892 | 10/1987 | Japan . | |
| 62-228895 | 10/1987 | Japan . | |
| 63-34493 | 2/1988 | Japan . | |
| 63-73095 | 4/1988 | Japan . | |
| 63-73096 | 4/1988 | Japan . | |
| 63-259396 | 10/1988 | Japan . | |
| 64-19296 | 1/1989 | Japan . | |
| 0611100 | 6/1978 | U.S.S.R. | 165/1 |

OTHER PUBLICATIONS

Augmentation of Condensation Heat Transfer Around Vertical Cooled Tubes Provided with Helical Wire Electrodes by Applying Nonuniform Electric Fields, A. Yabe et al.

"Heat Transfer Science and Technology" ed. by Bu-Z-uan Wang. Hemisphere (1987), pp. 812–819.

Heat Transfer Enhancement Techniques Utilizing Electric Fields, Akira Yabe et al.

"Heat Transfer in High Technology and Power Engineering" ed. by W. J. Yang & Mori, Hemisphere (1987), pp. 394–405.

Heat Transfer Augmentation Around a Downward-Facing Flat Plate by Non-Uniform Electric Fields, A. Yabe et al.

Proceedings of 6th International Heat Transfer Conference, vol. 3, Toronto, Canada, Aug., 1978, pp. 171–176.

Augmentation Mechanism of Burnout Heat Flux by Applying Electric Fields (1st Report: Latent Heat Flux and Its Enhancement by Electric Fields), 1987, ASME°JSME Thermal Engineering Joint Conference, Mar. 22-27, 1987, pp. 417–424.

(List continue on next page.)

*Primary Examiner*—John Ford

*Attorney, Agent, or Firm*—Oblon, Spivak, McClelland, Maier & Neustadt

[57] ABSTRACT

Electrodes are provided separated by spaces through which a liquid comes in and out, the electrodes being located 0.5 mm to 6.0 mm from the heat transfer surface in a liquid which has an electrical conductivity of $10^{-10}(1/(\Omega\cdot m))$ or more, the velocity of the flow being within the range of a Reynolds number for a laminar flow range, and a high-voltage direct current is applied to the electrodes to thereby produce turbulent components in the flow of the liquid to augment heat transfer between the liquid and the heat transfer surface.

6 Claims, 3 Drawing Sheets

OTHER PUBLICATIONS

Augmentation of Condensation Heat Transfer by Applying Electro-Hydro-Dynamical Pseudo-Dropwise Condensation, A. Yabe et al.

Proceedings of 8th International Heat Transfer Conference, San Francisco, USA, Aug. 17-22, 1986, vol. 6, pp. 2957-2962.

EHD Study of the Corona Wind Between Wire and Plate Electrodes, Akira Yabe et al.

Reprinted from AIAA Journal, vol. 16, No. 4, Apr. 1978, pp. 340-345.

Augmentation of Condensation Heat Transfer by Applying Non-Uniform Electric Fields, A. Yabe et al.

Proceedings of 7th International Heat Transfer Conference, vol. 5, Munich, West Germany, pp. 189-194.

Augmentation of Convective and Boiling Heat Transfer by Applying an Electro Hydrodynamical Liquid Jet, Akira Yabe.

Int. J. Heat Mass Transfer, vol. 31, No. 2, pp. 407-417, 1988.

METHOD AND APPARATUS FOR AUGMENTATION OF CONVECTION HEAT TRANSFER IN LIQUID

BACKGROUND OF THE INVENTION

1. Field of the Invention

The present invention relates to a method and apparatus for the augmentation of convection heat transfer in a liquid which utilizes hydrodynamic forces produced by an electrical field, and more particularly to a method and apparatus for the augmentation of convection heat transfer in a liquid whereby, in a fluid transferring layer formed between a flow of liquid driven by an external source of pressure difference and a tubular member, such as in a heat exchanger tube, turbulence is produced only in the liquid in the fluid heat transferring layer formed in the vicinity of the tube's heat transfer surface, thereby suppressing the pressure loss of the flow while at the same time augmenting the heat transfer.

2. Description of the Prior Art

The degree to which convection heat transfer taking place between a heat exchange tube and a liquid flowing in the heat exchange tube can be augmented depends on how large the heat flux from the heat transfer surface to the liquid (or vice versa) can be made.

Previously, convection heat transfer in the fluid heat transferring layer was augmented by creating turbulence in the thermal boundary layer by increasing the flow velocity of the liquid, increasing the Reynolds number, or by roughening the heat transfer surface and providing obstacles to the flow of the liquid.

However, the conventional methods of augmenting convection heat transfer by producing turbulence in the flow of the liquid have had the following drawbacks.

As the turbulence produced in accordance with the above methods of augmenting convection heat transfer increases the resistance to the flow of the liquid, there is an increase in the flow energy loss and the pressure loss which necessitates the use of a larger pump, for example, resulting in higher operating costs and increased energy consumption. When the pressure loss of the flow cannot be increased, the flow velocity has to be decreased. This produces a decrease in the heat transfer coefficient and, when the method is applied to a heat exchanger, a decrease in the heat exchange efficiency.

In Japanese Patent Publication No. 59-66342 and U.S. Pat. No. 4,818,184, the present inventors disclose a method of utilizing hydrodynamic turbulence to agitate all of the fluid by providing surface electrodes and spatial electrodes arranged in opposition in the liquid and applying a high voltage across the electrodes to generate a jet stream in the liquid. Generating a high-velocity jet stream is an effective way of agitating all of the fluid but is difficult to apply to the augmentation of convection heat transfer of the liquid driven by the pressure difference through the production of turbulence only in liquid in the heat transferring layer in the vicinity of the heat transfer surface, such as when the pressure loss cannot be increased to an extent that will give rise to turbulence, or in the case of a slow flow in which a high degree of pressure loss is not possible.

SUMMARY OF THE INVENTION

An object of the present invention is to provide a method and apparatus for the augmentation of convection heat transfer in a liquid by producing turbulent components of the velocity only in the liquid of a thermal boundary layer while suppressing fluid pressure loss.

For attaining the aforesaid object, the present invention provides electrodes separated by spaces through which a liquid comes in and out and spaced 0.5 mm to 6.0 mm from the heat transfer surface, producing a turbulence over the heat transfer surface of the liquid which has an electrical conductivity of $10^{-10}(1/\Omega\cdot m)$) or more at a velocity within a Reynolds number of laminar flow range, and applying a DC voltage to the electrodes to produce turbulent components in the liquid flowing in the thermal boundary layer to thereby augment convection heat transfer between the liquid and the heat transfer surface.

In the arrangement of the invention as described above, as turbulence is produced only in the liquid flowing in the thermal boundary layer, an efficient transfer of heat from the thermal boundary layer to the liquid can be achieved with virtually no loss of fluid pressure in the viscous boundary layer.

These and other objects and features of the invention will be better understood from the following detailed description made with reference to the drawings.

BRIEF DESCRIPTION OF THE DRAWINGS

FIG. 4 (*b*) is an explanatory drawing illustrating the velocity distribution of a liquid in a tube, in accordance with the invention.

DESCRIPTION OF THE PREFERRED EMBODIMENTS

Figure 1:
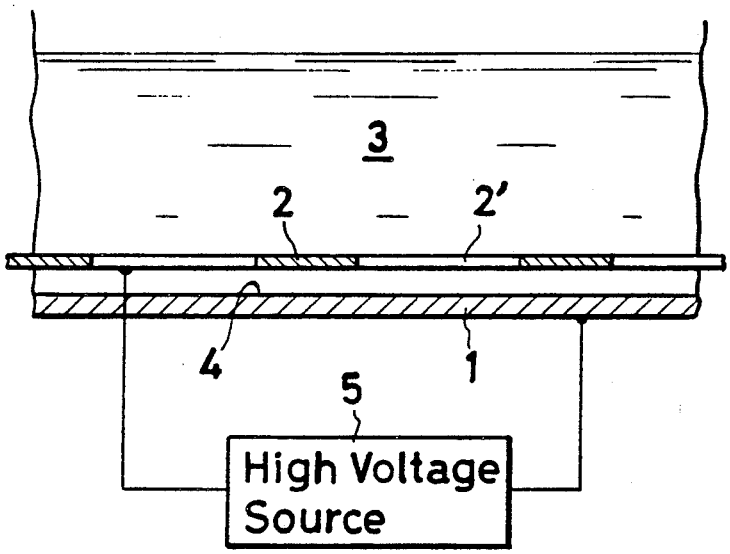
FIG. 1 is a drawing showing the basic structure of the apparatus for the augmentation of convection heat transfer in a liquid in accordance with the present invention.

FIG. 1 shows the basic structure of the apparatus for the augmentation of convection heat transfer in a liquid in accordance with the present invention. With reference to FIG. 1, electrodes 2 spaced apart by a prescribed distance are disposed opposite a heat transfer surface 4 of a heat transfer member 1 in which a liquid 3 flows. As well as transferring heat to the liquid, the heat transfer surface 4 of the heat transfer member 1 also functions as a ground electrode, and therefore it is constituted of a material which has good electrical and thermal conductivity.

Preferably the electrodes 2 disposed opposite the heat transfer surface 4 are configured in a way that does not produce increased flow resistance. It is also necessary to separate the electrodes by spaces 2' to allow an exchange of momentum and heat to take place in the liquid 3 on both sides of the electrodes 2. There is no particular limitation on the shape of the electrodes, other than that the configuration should not be one that gives rise to the formation of a jet stream in the liquid.

Thus, the electrodes may be configured as a multiplicity of metal wires stretched in parallel, as a metal mesh, or as perforated metal plates. In view of the requirements described above, electrodes of metal mesh are particularly suitable, or electrodes of metal wire, which would enable the cross-sectional area to be reduced, decreasing resistance to the liquid, and the spaces 2' to be increased. To prevent jet streams arising in the liquid, wire electrodes have to be spaced a uniform distance apart, while in the case of perforated plate electrodes the shape and the dimensions of the spaces 2' have to be substantially identical.

Figure 2:
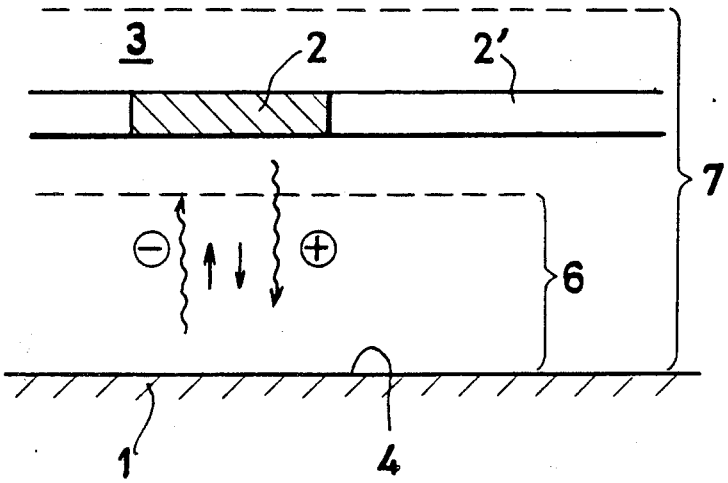
FIG. 2 is an explanatory drawing illustrating the transfer of heat in the convection heat transfer augmentation apparatus.

Preferably the space between the heat transfer surface 4 and the electrodes 2 is about the same as, or slightly larger than, the thickness of a thermal boundary layer 6 formed in the vicinity of the heat transfer surface 4 in contact with the liquid 3 via which the transfer of heat takes place, and about the same as, or slightly thinner than, the thickness of the viscous boundary layer. That is, as shown in FIG. 2, in the vicinity of the heat transfer surface 4 there are a thermal boundary layer 6 that is the extent of the range of thermal conductivity and a viscous boundary layer 7 that is the extent of the range of the viscosity of the liquid.

The thickness $\delta$ of the viscous boundary layer 7 is given by $\sqrt{(\nu \cdot X)/U}$, where $\nu$ is the kinematic viscosity of the liquid, X is the length of the heat transfer member and U is the flow velocity of the liquid driven by an external source of pressure difference so that with a Reynolds number of $Re=(U \cdot X)/\nu$, the thickness $\delta$ of the viscous boundary layer will be $X/(\sqrt{Re})$.

The ratio of the thickness of the thermal boundary layer to that of the viscous boundary layer (viscous boundary layer thickness/thermal boundary layer thickness) is shown by the Prandtl number $(=\nu/(\lambda/\rho C\rho))$, where $\lambda$ is thermal conductivity, $\rho$ is density and $C\rho$ is specific heat at constant pressure. The Prandtl number of a Freon (CFC or HCFC) is around 4 and that of oil is around 100; the Prandtl number of the subject fluid, in which the thermal boundary layer is thinner than the viscous boundary layer, is normally no more than a fraction of 1.

The thickness of the thermal boundary layer 6 in normal convective heat transfer is within the range of the laminar flow that has been influenced mainly by the viscosity over the total flow (a Reynolds number of up to several thousand, when the heat transfer surface is a flat plate), or around 0.1 mm to 3.0 mm, and hence the gap between the electrodes 2 and the heat transfer surface 4 preferably is around 0.5 mm to 6.0 mm.

The characteristic charge relaxation time tc of the liquid (heat transferring medium) which receives the heat transferred from the heat transfer surface 4 is represented as a ratio of the electrical conductivity $\sigma e$ and the dielectric constant $\epsilon$, thus $(\epsilon \cdot \epsilon o)/\sigma e$ . In the equation, $\epsilon o$ is the dielectric constant in a vacuum. It is preferable that the charge relaxation time is smaller than the characteristic flow time D/U (D being heat transfer surface and U the flow velocity). For example, if a tube the inside diameter of which is 10 mm is taken as the length of the heat transfer surface and 100 mm/sec is the mean flow velocity, the characteristic flow time D/U would be 100 ms, so when the dielectric constant $\epsilon$ is 2, if the electrical conductivity $\sigma e$ is larger than $2\times10^{-10}(1/(\Omega \cdot m))$, the charge relaxation time of the liquid would be smaller than 100 ms, where the effects of applying electric fields become marked. Liquids having such properties include R123, a Freon substitute, silicon oil, and transformer oil.

Preferably the flow velocity of the liquid over the heat transfer surface 4 is within the range of a laminar flow with a low pressure loss. For example, when the heat transfer surface is a round duct, with the Reynolds number $(Re=(U \cdot X)/\nu)$ being a function that is proportional to the flow velocity, the target is a Reynolds number in the range 2000 to 4000, and when the heat transfer surface is a flat plate, the target is a Reynolds number in the range below $5\times10^5$.

If the flow velocity of the liquid is higher than this range there will be a transition to a turbulent flow and an increase in the pressure loss. If the flow velocity is smaller than this range, the heat transfer augmentation effect will be increased by just the amount concerned.

With the above configuration, if a voltage of 1000 to 3000 volts is applied between the heat transfer member 1 and the electrodes 2, as shown in FIG. 2 (which shows when the negative is applied to the heat transfer member 1 and the positive to the electrodes 2), ions from the electrodes and ions present in the liquid will move in the space between the electrodes 2 and the heat transfer surface 4, and the Coulomb force exerted on the ions by the electrical field produces turbulent components of velocity in the liquid in the thermal boundary layer 6, giving rise to a turbulent flow. As a result, heat transfer is augmented as near-turbulent heat transfer and, although the flow resistance increases somewhat as a result of a decrease in the thickness of the viscous boundary layer 7, owing to the slow velocity of the main flow, in the region of the main flow there is an attenuation of the turbulent components, i.e., of the time fluctuation components of the flow velocity, so that there is little overall increase in the pressure loss, which remains small compared to turbulent heat transfer realized by the usual method.

Since virtually no movement of ions would be present except between the heat transfer surface and the electrodes, there occurs virtually no velocity fluctuation, i.e. no turbulence. Furthermore, ion movement between the heat transfer surface 4 and the electrodes 2 is perpendicular to the mean flow, so there is an increase in heat and momentum exchange perpendicular to the flow.

Figure 3:
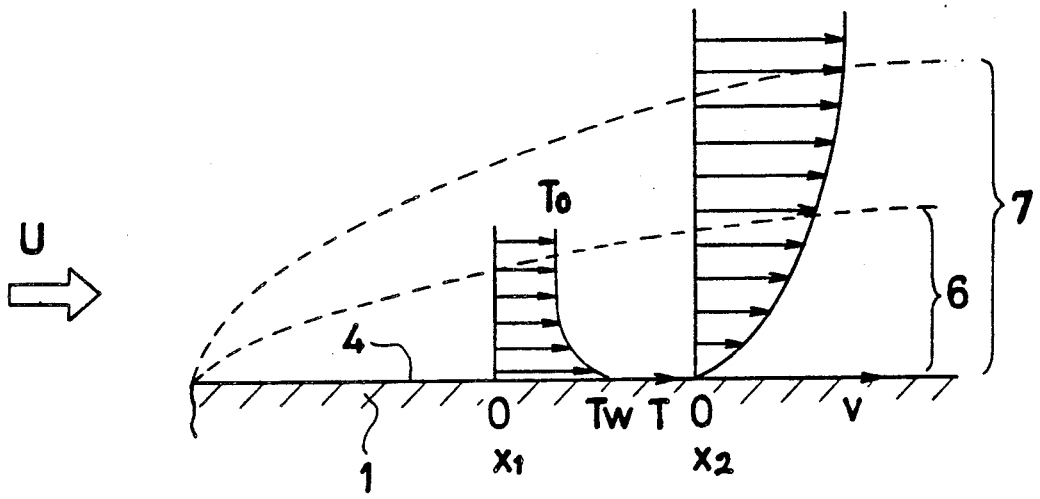
FIG. 3 is an explanatory drawing illustrating temperature and velocity distributions in the liquid, with the apparatus.

With reference to FIG. 3, at a point $X_1$ in the temperature distribution in the flow of the liquid 3, driven by an external source of pressure difference in the region of the heat transfer surface 4 the temperature To of the liquid changes to the temperature Tw of the heat transfer surface 4 (the length of the arrows indicates the magnitude of the temperature), and there is almost no change in the upper part of the thermal boundary layer 6. At a point $X_2$ in the velocity distribution of the flow of the liquid 3, velocity at the heat transfer surface is zero and there is a small velocity near the heat transfer surface, the velocity gradually increasing towards the outer edge of the viscous boundary layer.

Thus, in accordance with this invention, turbulence is produced hydrodynamically only in the liquid in the thermal boundary layer, enabling the thickness of the thermal boundary layer to be decreased, providing a low-pressure-loss, high-efficiency-heat-transfer convection heat exchange apparatus in which a lower main flow velocity can be used to obtain the same heat transfer coefficient.

Figure 4A:
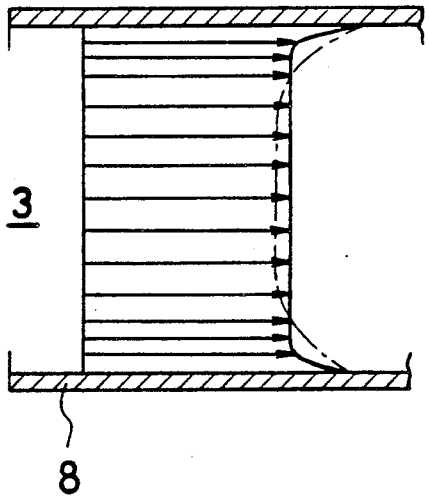
FIG. 4 (*a*) is an explanatory drawing illustrating the temperature distribution of a liquid in a tube, in accordance with the invention.
Figure 4B:
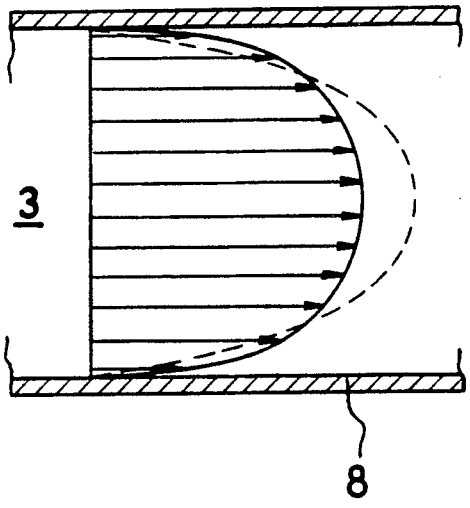

FIG. 4 shows the temperature distribution in a tube 8 in accordance with the present invention, in which only the liquid in the vicinity of the inner wall of the tube transfers heat from the inner wall and undergoes a sharp change. For reference, the temperature distribution at the point the application of the voltage is stopped is shown by the dashed line. As shown in FIG. 4 (*b*), which illustrates the velocity distribution of the liquid in the tube, a relatively sharp velocity gradient exists only near the inner wall of the tube, the velocity increase being gradual going towards the center. The dashed line shows the velocity distribution in the liquid when no voltage is being applied.

Since the viscous effects are relatively large in the boundary layer, in which there is a change of temperature, the flow velocity is largely reduced. As a consequence of the small transportation rate of the viscous boundary layer, the degree of convection heat transfer from the wall is determined by the state of the liquid flow. Thus, an effective way is to promote transport from the wall by utilizing the turbulent components of the flow to increase the transport phenomena derived from the creation of a turbulent flow in the thermal boundary layer.

Figure 5:
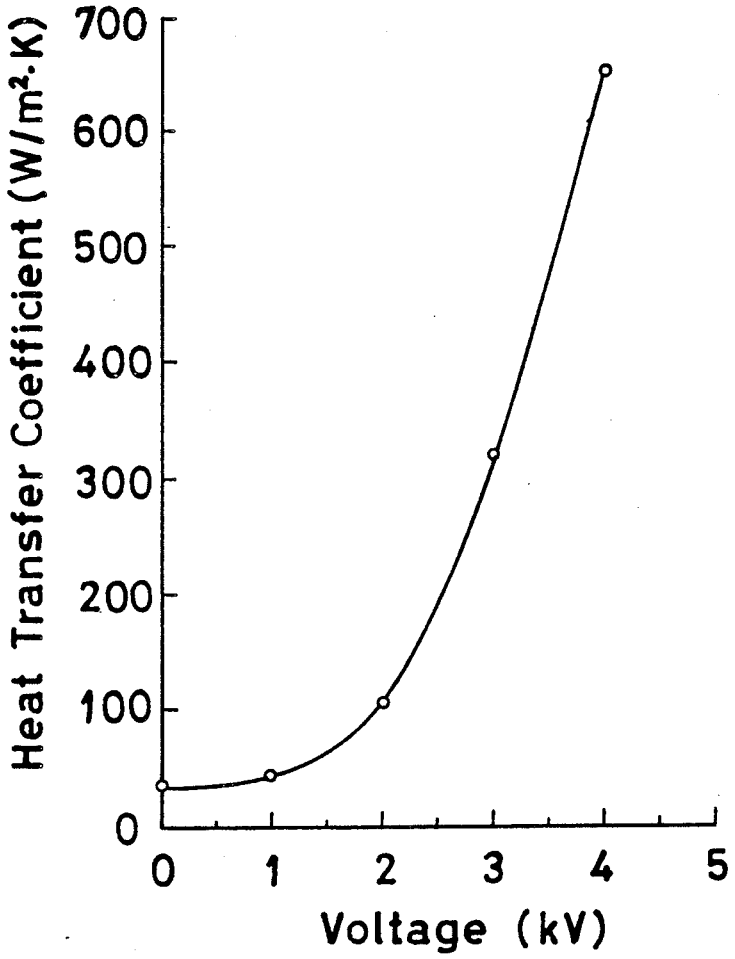
FIG. 5 is a graph showing the relationship between an applied voltage and heat transfer coefficient in the apparatus of the invention.

As one example, heat transfer experiments were conducted in which two copper heat transfer surfaces 20 mm apart were heated to a heat differential of 5 K relative to the liquid, a multiplicity of wires 0.3 mm in diameter and each separated from the next by a distance of 10 mm were positioned 6 mm away from the lower of the heat transfer surface, a flow of a liquid consisting of Furonsorubu AE (R 113: 96 wt%; ethanol: 4 wt%) was produced across the heat transfer surface, and a direct current was applied to the electrodes, using a Reynolds number of 1000. The results are shown in FIG. 5. The heat transfer coefficient was about 24.9 $W/(m^2 \cdot K)$ when no electricity was applied. With a direct current of 3 kV, the heat transfer coefficient rose to around 320 $W/(m^2 \cdot K)$, and to about 650 $W/(m^2 \cdot K)$ with a direct current of 4 kV, or over a 25-fold increase in the coefficient compared to when no electricity is applied.

From the foregoing description, the present invention utilizes hydrodynamic forces to produce the turbulent components and thereby induces turbulence only in liquid within the thermal boundary layer, thereby suppressing the pressure loss and augmenting the heat transfer process by a change to turbulent heat transfer.

Applying the invention to heat exchangers enables the mean flow velocity of the liquid to be reduced. This means that the pressure loss can be made lower, so a less powerful pump can be used. This makes it particularly suited to pressure loss suppression applications, and as the area of the heat transfer surface can be reduced, the heat exchanger can be made more compact.

What is claimed is:

1. An apparatus for augmentation of convection heat transfer in a liquid, the apparatus comprising:

an electrically conductive material having a heat transfer surface;

means for supplying a single phase liquid having an electrical conductivity of not less that $10^{-10}$ $(1/\Omega \cdot m)$ to the heat transfer surface with a flow velocity driven by an external source of fluid pressure difference, wherein the liquid has sufficient flow velocity for forming a thermal boundary layer in a vicinity of the heat transfer surface and a viscous boundary layer, and wherein a Reynolds number of the flow velocity is within a laminar flow range;

an electrode, having low flow resistance, disposed at a boundary between the thermal boundary layer and the viscous boundary layer, for creating turbulence in the liquid when a current is applied thereto;

means for applying a direct current to said electrode;

wherein, when the direct current is applied to the electrode, turbulence is produced only at said thermal boundary layer of said liquid.

2. An apparatus according to claim 1, wherein the electrode is provided with openings, of substantially the same size, to permit flow of the liquid therethrough.

3. An apparatus according to claim 1, wherein electrode is spaced from the heat transfer surface by a distance of about 0.5 to 6.0 mm.

4. A method for augmentation of convection heat transfer in a liquid, the method comprising the steps of:

supplying a liquid having an electrical conductivity of not less that $10^{-10}(1/\Omega \cdot m)$ to a heat transfer surface of an electrically conductive material with a flow velocity driven by an external source of fluid pressure difference, the liquid having sufficient flow velocity for forming a thermal boundary layer in a vicinity of the heat transfer surface and a viscous boundary layer, and a Reynolds number of the flow velocity being within a laminar flow range;

disposing an electrode, with low flow resistance, at a position substantially at a boundary between the thermal and viscous boundary layers; and applying a direct current to the electrode to produce turbulence in the thermal boundary layer to augment heat transfer between the liquid and the heat transfer surface and minimize loss of fluid energy.

5. A method according to claim 4, wherein the electrode is disposed in the viscous boundary layer substantially at the boundary between the viscous and thermal boundary layers.

6. A method according to claim 4, wherein the electrode is positioned at about 0.5 to 6.0 mm from the heat transfer surface.

* * * * *